United States Patent [19]

Tudor

[11] 4,340,074

[45] Jul. 20, 1982

[54] CIGARETTE MATERIAL HAVING NON-LIPSTICKING PROPERTIES

[75] Inventor: Thomas T. Tudor, Crestwood, Ky.

[73] Assignee: Brown & Williamson Tobacco Corporation, Louisville, Ky.

[21] Appl. No.: 225,582

[22] Filed: Jan. 16, 1981

Related U.S. Application Data

[62] Division of Ser. No. 92,149, Nov. 7, 1979, abandoned.

[51] Int. Cl.[3] ..... A24D 1/04; A24D 3/00; A24D 3/18

[52] U.S. Cl. ..... 131/362; 131/365; 131/336; 131/281; 131/284

[58] Field of Search ..... 131/281, 284, 365, 361, 131/362, 336

[56] References Cited

U.S. PATENT DOCUMENTS 2,149,896 3/1939 McArdle et al. ..... 131/362
4,174,719 11/1979 Martin et al. ..... 131/336

*Primary Examiner*—V. Millin
*Attorney, Agent, or Firm*—Charles G. Lamb

[57] ABSTRACT

A cigarette tipping material having non-lipsticking properties includes preselected areas of the tipping material provided with non-lipsticking coatings with other preselected uncoated areas having perforations therein.

3 Claims, 3 Drawing Figures

CIGARETTE MATERIAL HAVING NON-LIPSTICKING PROPERTIES

This is a division of application Ser. No. 092,149, filed Nov. 7, 1979 now abandoned.

BACKGROUND OF THE INVENTION

This invention relates to an improved cigarette tipping material and more particularly relates to a cigarette tipping material having a non-lipsticking coating on preselected areas thereof.

In the manufacturing of cigarettes it is common practice to apply a coating on the tipping material of the cigarettes to reduce or prevent lipsticking; that is, to prevent the tendency of the wrapping around a cigarette filter which comes in contact with the smoker's lips to adhere thereto. Presently, there is known in the art several different methods for coating the tipping of cigarettes to prevent or at least reduce the sticking of cigarette wrapping or material to the smoker's lips during use. British Pat. No. 328,147 relates to a cigarette having a tip or end that prevents sticking to the lips wherein the coating is applied to preselected surfaces on the tip. U.S. Pat. No. 288,151 teaches a cigarette wrapper having preselected areas with the coating thereon which is applied in a form of a design. U.S. Pat. No. 2,033,791 teaches a water-proof tip for cigarettes which is "lip-proof" and only preselected portions of the tobacco paper are coated and this coating is applied for strengthening the paper. Other patents which teach coating of the wrapper to prevent sticking to the lips include U.S. Pat. No. 2,217,527; U.S. Pat. No. 2,159,704 and U.S. Pat. No. 2,149,896.

SUMMARY OF THE INVENTION

In the present invention, it is recognized that it is desirable to provide a cigarette tipping material with non-lipsticking properties. Furthermore, it is recognized that it is desirable to provide a cigarette tipping material having air ventilating perforations in the tipping material for mixing of air with the smoke stream at the filter end of a cigarette.

The present invention advantageously provides a cigarette tipping material having non-lipsticking properties. The present invention further provides cigarette tipping material which has non-lipsticking properties and is also provided with air ventilating perforations therein. Even further, the present invention provides a method of making cigarette tipping material having a coating in preselected areas thereon with non-lipsticking properties and perforations in non-coated areas wherein the method includes means that eliminates clogging of the perforations with coating material and eliminates build-up or other problems with the means for adding the perforations thereby reducing downtime, machine clean-up and provides for a consistent perforated product.

Various other features of the present invention will become obvious to those skilled in the art upon reading the disclosure set forth hereinafter.

More particularly, the present invention provides a cigarette tipping material comprising:

- a sheet of tipping material;
- a coating having non-lipsticking properties covering preselected areas of the sheet; and,
- perforations in the sheet, said perforations being located in areas not covered by said coating.

It is to be understood that the description of the examples of the present invention given hereinafter are not by way of limitation and various modifications within the scope of the present invention will occur to those skilled in the art upon reading the disclosure set forth hereinafter.

BRIEF DESCRIPTION OF THE DRAWING

Referring to the drawing.

DESCRIPTION OF THE PREFERRED EMBODIMENT OF THE INVENTION

Figure 1:
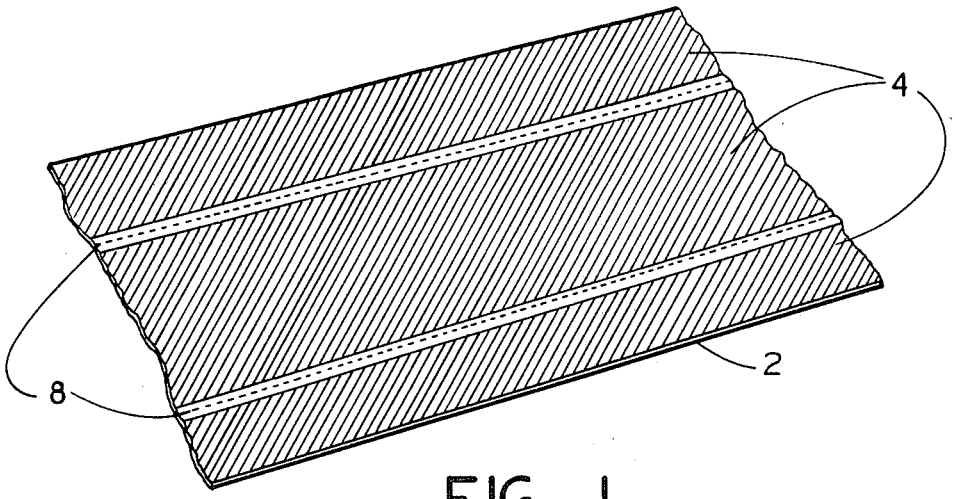
FIG. 1 is a perspective view of a sheet of cigarette tipping material of the present invention.
Figure 2:
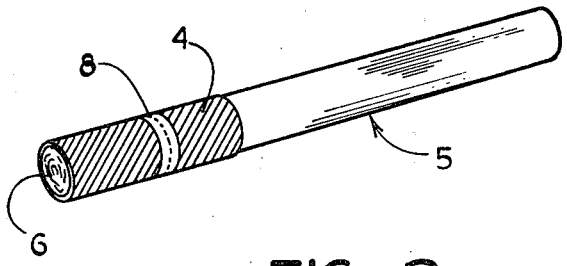
FIG. 2 is a perspective view of a cigarette using the tipping material of FIG. 1; and, FIG. 3 is a schematic view, in perspective, of one preferred embodiment of making the tipping material of FIG. 1.

In FIG. 1 a sheet of tipping material 2 is provided with preselected areas 4 coated with non-lipsticking or lip releasing type material thereon. These coatings with the non-lipsticking properties include ethyl cellulose, nitrocellulose, or any other well known agent used for preventing the sticking of a smoker's lip to a cigarette. The coating may be applied along various configurations and as shown is applied along spaced parallel straight lines running the length of the paper and in use, as shown in FIG. 2, extends around the filter 6 of a cigarette 5. The uncoated areas of the tipping paper is also provided with spaced parallel straight lines of perforations 8 which also encircle a filter 6 (as shown in FIG. 2) thereby allowing air into the smoke stream as it passes through the filter 6 when in use.

Figure 3:
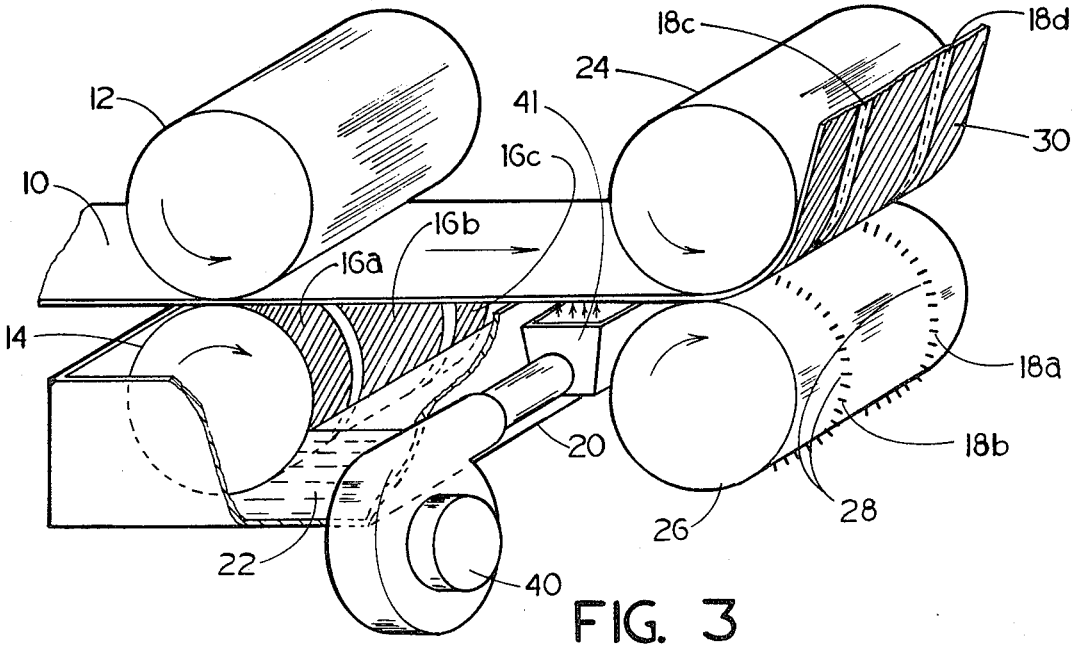

In a preferred method of making tipping material of the present invention, as shown in FIG. 3, unprinted tipping paper 10 is fed to a pair of synchronized rollers 12 and 14. Roller 12 is a pressure roller and roller 14 is a gravure printing roller having preselected engraved areas therein, the engraved areas being identified by the numerals 16*a*, 16*b* and 16*c* so that as the roller 14 passes through a reservoir 20 having a coating 22 therein the coating does not transfer or adhere to the unengraved areas of the roller gravure cylinder. Thus, as the sheet 10 passes between the rollers 12 and 14, coating is applied to the underside of the tipping paper in a preselected pattern. The tipping paper 10 leaving the coating step of the preparation is then fed into a drier for drying the coating. The drier includes air blower 40 and a fire-box 41 for heating air and directing same to the paper 10 passing therethrough. It is realized that the drier as shown is for illustrative purposes only as any means for drying known in the art may be utilized. Paper 10 is then fed into a pair of synchronized rollers 24 and 26. The roller 26 is provided with a pair of parallel rings 18*a* and 18*b* wherein the rings are provided with a plurality of pins 28 which, upon rotation of the cooperating rollers 24 and 26, perforate the tipping paper. It is noted that the rings 18*a* and 18*b* are in alignment with the unengraved portions of the cylinder so that when the tipping paper passes between the cooperating rollers 24 and 26 the pins 28 perforate the tipping paper in the uncoated area of the paper 10. The product leaving the rollers 24 and 26 shows the uncoated portion having rows of apertures therein, identifiable by the numerals 18*c* and 18*d*, and a coated area 30. The tipping paper is then ready for use with a cigarette filter.

It is realized that the tipping material may be perforated prior to coating and that various other changes may be made to the specific embodiments shown and described without departing from the principles and spirit of the present invention.

What is claimed is:

1. A method of making a cigarette tipping material comprising the steps of:

(a) passing a sheet of tipping material through a means for adding a coating having non-lipsticking properties thereto in a preselected pattern, said means to add a coating including a pair of cooperating rollers, one of said rollers being a pressure roller, the other of said rollers being a rotogravure roller having an unengraved surface therein in preselected areas, said rollers being mounted in contacting relationship to receive said tipping material therebetween;

(b) drying the coating; and, (c) passing the coated material through means to add perforations thereto.

2. The method of claim 1 wherein said rotogravure roller is in contacting relationship with said coating material.

3. The method of claim 1 wherein said means for forming perforations is a pair of cooperating rollers, one of said rollers being a pressure roller, the other of said rollers having a ring of pins therearound, said ring being in alignment with said unengraved surface of said rotogravure cylinder whereby said perforations are made in the uncoated area of said tipping paper.

* * * * *